US006266822B1

(12) United States Patent
Joyce

(10) Patent No.: US 6,266,822 B1
(45) Date of Patent: Jul. 31, 2001

(54) SLEEPWEAR AND SECURED BLANKET-LIKE MEMBER

(76) Inventor: Diane Joyce, 16 Coolidge Dr., Acton, MA (US) 01742

( * ) Notice: Subject to any disclaimer, the term of this patent is extended or adjusted under 35 U.S.C. 154(b) by 0 days.

(21) Appl. No.: 09/657,854

(22) Filed: Sep. 8, 2000

(51) Int. Cl.[7] ..... A41D 11/00
(52) U.S. Cl. ..... 2/83; 2/80; 2/69; 2/69.5
(58) Field of Search ..... 2/83, 80, 69.5, 2/69

(56) References Cited

U.S. PATENT DOCUMENTS

| | | | | |
|---|---|---|---|---|
| 1,940,224 | * | 12/1933 | Munro | 2/69 |
| 2,101,701 | * | 12/1937 | Cohen | 2/83 |
| 2,292,600 | * | 8/1942 | Baum | 2/69 |
| 2,355,138 | | 8/1944 | Bell | 2/114 |
| 2,439,101 | | 4/1948 | Rogers | 2/114 |
| 2,469,556 | * | 5/1949 | Jacobson | 2/83 |
| 2,651,781 | * | 9/1953 | Buchholz | 2/69 |
| 2,888,009 | | 5/1959 | Taylor | 128/134 |
| 2,908,912 | * | 10/1959 | Darling | 2/83 |
| 3,521,309 | | 7/1970 | Evans | 5/336 |
| 3,845,513 | | 11/1974 | Hubner | 5/336 |
| 3,872,524 | | 3/1975 | Hummel | 5/334 |
| 4,688,282 | | 8/1987 | Jeffries | 5/413 |
| 5,226,193 | * | 7/1993 | Chen | 2/69.5 |
| 5,416,938 | | 5/1995 | Li | 5/494 |
| 5,933,886 | | 8/1999 | Washington | 5/494 |

* cited by examiner

*Primary Examiner*—Gloria M. Hale
(74) *Attorney, Agent, or Firm*—Ernest V. Linek; Banner & Witcoff, Ltd.

(57) ABSTRACT

A clothing combination for keeping a person warm including sleepwear and a blanket-member that can be secured to the pajama. The sleepwear covers the legs, torso and arms of a person, and has fastening means placed across the front and back of the upper torso for fastening the blanket-member to the sleepwear. The blanket-member has a bag-like configuration that is formed from two equal sized portions that are sealed together at all but one edge to create an opening that enables the sleepwear to be placed inside the blanket-member. The blanket-member has fastening-members that are located inside the blanket-member and positioned to align with the fastening-members of the sleepwear when the blanket-member is placed around the sleepwear, such that the blanket may be fastened and thereby secured to the pajama.

6 Claims, 2 Drawing Sheets

SLEEPWEAR AND SECURED BLANKET-LIKE MEMBER

FIELD OF THE INVENTION

This invention relates to clothing for keeping a person warm, and more specifically to a clothing combination comprising sleepwear such as pajamas, night shirts, and the like and a blanket-like member that is secured to the sleepwear.

BACKGROUND OF THE INVENTION

This application relates to the means of keeping a person, advantageously an infant, warm by securing a blanket-like member to the person's clothing, for example, sleepwear such as night shirts, pajamas or the like. In particular, this invention keeps the blanket-like member secure and in one place relative to the person while the person sleeps.

A general problem for sleeping persons, particularly infants and young children, is that a blanket covering the sleeping person often will either be pulled over their head or alternatively pushed aside by bodily movements during sleep. In the instance where a blanket is pulled over the head, the sleeping person risks suffocation. Thus, one object of this invention is to avoid possible suffocation. In the instance where a blanket is pushed aside during sleep, the person can be exposed to cold air, causing discomfort and susceptibility to illness. Another object of the invention therefore is to keep a blanket covering the person at night so they do not become cold.

In light of the problems associated with conventional sleepwear and blankets, many patents of the prior art show there is a desire to address the problems by fastening coverings such as blankets or quilts to the person, either as an integral part of their clothing or by attaching a covering to the clothing by a fastening means. The following patents are illustrative of these attempts:

Li, U.S. Pat. No. 5,416,938, issued May 23, 1995, discloses a fastener for preventing quilts from being kicked off. The fastener includes a wrapping sheet and a quilt which have corresponding hook-and-loop type fasteners for wrapping a child's body and firmly securing the quilt over the child.

Bell, U.S. Pat. No. 2,355,138, issued Aug, 8, 1944, discloses a combination sleeping garment for infants, comprising a blanket and a jacket, which covers the arms and torso of the infant. The blanket has a means of being attached to a crib. The jacket may be attached to the blanket by a fastening means, for instance a zipper, thereby securing the infant under the blanket in a position where the infant's torso is fixed relative to the blanket. The infant may be placed in the jacket to allow either a face up or face down sleeping position when the jacket is fastened to the blanket.

Evans, U.S. Pat. No. 3,521,309, issued Jul. 21, 1970, discloses a restraining sheet particularly adapted for use in cribs to maintain the desired sheet and blanket coverage over an infant. The restraining sheet is a combined pocket-containing crib sheet and blanket in which the crib sheet is placed over a mattress and preferably held in place by straps that are tied together. The blanket is attached to the pocket by a fastening means and thereby maintained in the desired position with respect to the pocket. The infant is placed in the pocket of the crib sheet for sleeping.

Rogers, U.S. Pat. No. 2,439,101, issued Apr. 6, 1948, discloses a safety gown for bed patients and is particularly designed for infants to keep them covered and in a particular area of a bed, carriage or the like. The safety gown comprises a body portion including sleeves, where the body portion extends substantially to the waist of the infant. The remaining portion of the gown constitutes a sheet-like element which forms a long apron or blanket that covers the infant below the waist and which can be tucked in under a mattress or otherwise secured to maintain the infant in a predetermined area of the bed or carriage.

Taylor, U.S. Pat. No. 2,888,009, issued May 26, 1959, discloses an infant's sleeping bag which has ties at the four comers of the bag for attaching the garment to portions of the crib, bed, or the like upon which it is placed. The bag has an opening consisting of a neck opening and a slit, such that the slit can be closed by a fastening means, for instance a zipper. The infant's head is therefore held in position outside of the bag at the neck opening, while the remainder of the infant's body is held in the bag and covered from the neck down.

Hubner, U.S. Pat. No. 3,845,513, issued Nov. 5, 1974, discloses a sleeping bag in which a sleeping blanket is attached, in the area of the back, to a bedlinen sheet which can be stretched and fittedly attached to a crib mattress. The blanket contains a bodice-like upper portion with a zipper opening and a bag-like lower portion. A baby is placed in the bag either face up or face down, and the bag restrains the baby from standing up or removing the clothes.

Hummel, U.S. Pat. No. 3,872,524, issued Mar. 25, 1975, discloses a baby cover that comprises a jacket-shaped section that is continuous with a rectangular section, whereby the rectangular section is held on a mattress by fasteners at the corners and adapted to be attached to a crib by straps so as to prevent movement of the cover. A slit extends from the bottom of the jacket neck hole into a portion of the rectangular section, and is closed with a zipper, so that a baby is covered from the waist up in the jacket section of the cover, with the baby's lower body covered and held under the rectangular portion of the cover.

Jeffries, U.S. Pat. No. 4,688,282, issued Aug. 25, 1987, discloses bedding for children that comprises a generally rectangular blanket that has several fasteners on it. The blanket is can be wrapped around a child's torso, lower body and legs and held in place with fasteners on the side and bottom edges of the blanket. A pair of straps is located on the top edge of the blanket and to fit over the child's shoulders, and centrally located fastener is adapted to secure the blanket between the child's legs to prevent the blanket from being upwardly displaced.

Washington, U.S. Pat. No. 5,933,886, issued Aug. 10, 1999, discloses a blanket for snugly engaging the body of a baby. The blanket includes a bottom portion having a head end, a leg end, a torso section lying between the ends, and a pair of arms extending from opposite sides of the torso section. A top section covers the leg end and the torso section of the bottom portion, and is held in place by the arms of the bottom section, which extend through slots in the top section. The arms fasten together to secure the top and bottom portions of the blanket around a baby.

These attempts to provide a means of securing a covering to a sleeping person suffer from several limitations that make them either impractical or undesirable to use. These limitations include fasteners that are awkward to use, covers that can only be used when fitted to a mattress or other sleeping surface, covers that restrict a sleeping position to either face up or face down, and covers that restrain or restrict a person's bodily movement so that the cover is uncomfortable as well as potentially unsafe to the person. Thus there remains a need in the art for a means of securing a blanket to a person's clothing that is both safe and easy to use.

SUMMARY OF THE INVENTION

The present invention accomplishes the desired result by providing a unique clothing and blanket-like member set. The chest portion of the clothing and the back shoulder blade portion have two or more snap members (male or female) located thereon. The blanket-like member, which advantageously has a bag-like configuration (three closed sides and one open side) is provided with a plurality of reciprocal snap members (female or male) located in the appropriate places to allow the blanket to be fastened to the chest and back shoulder blade portions of the clothing.

DETAILED DESCRIPTION OF THE PREFERRED EMBODIMENT

As described above, the present invention presents an effective way of keeping a person warm by keeping a blanket-like member securely fastened in place while the person sleeps.

In the preferred embodiments, the present invention includes clothing that may be, but is not limited to, pajama sleepwear. According to the invention, a pajama has been modified by the addition of two or more fastener-members at chest level and two or more fasteners at shoulder blade level on the back. The preferred bag-like configuration of the blanket-member of the invention is closed on three sides, leaving the top open. The blanket-member has reciprocal fastener-members that are appropriately placed so that when the blanket-member is placed around the legs and torso of a person wearing the pajama, the reciprocal fastener-members of the blanket-member align with the fastener-members at the chest and shoulder blade sections of the pajama, allowing the blanket-member reciprocal fastener-members and their pajama fastener-member counterparts to be fastened. The fastener-members will in turn keep the blanket-member securely in place.

Figure 1A:
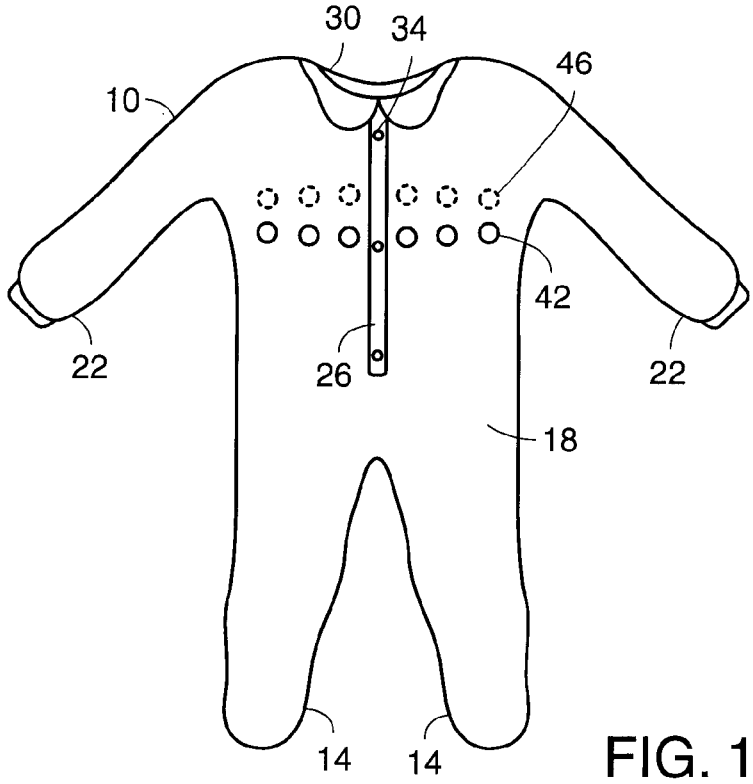
FIG. 1A is a front view of one embodiment of a pajama as used in the present invention.
Figure 1B:
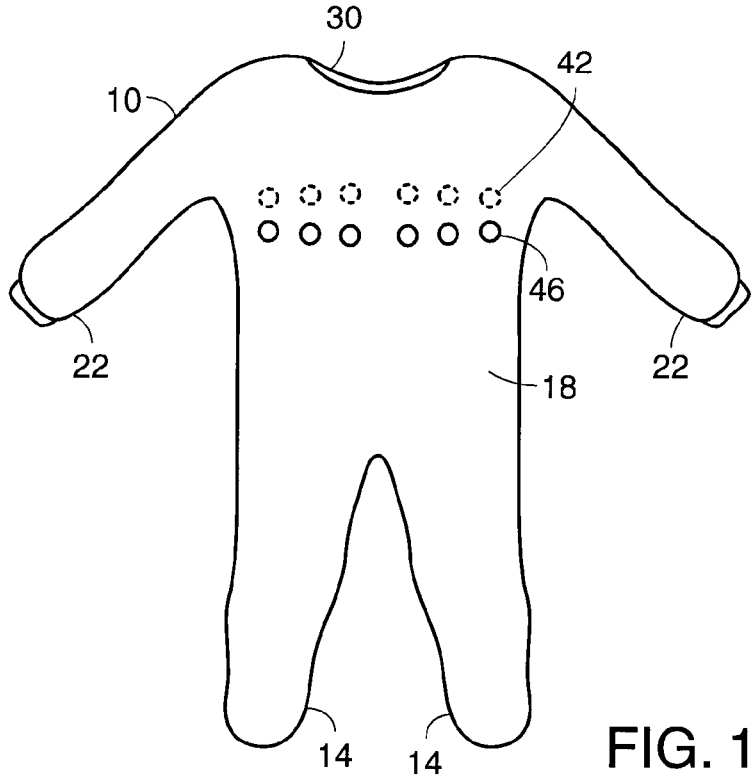
FIG. 1B is a back view of the pajama of FIG. 1A.

Referring to the drawings, a preferred pajama, in accordance with the present invention, is shown at 10 in FIG. 1A and FIG. 1B. As shown, the pajama may be, but is not limited to, a sleeper type pajama that typically covers the feet and legs 14, torso 18, and arms 22 of the wearer. The front of the pajama has a slit 26 that extends from the neck opening 30 to a position in the lower torso or alternatively, to an upper portion of one of the pajama legs. A fastening means 34, such as a zipper or series of buttons or snaps is affixed to the front of the sleeper, so that the slit 26 may be fastened in a closed position.

Figure 2:
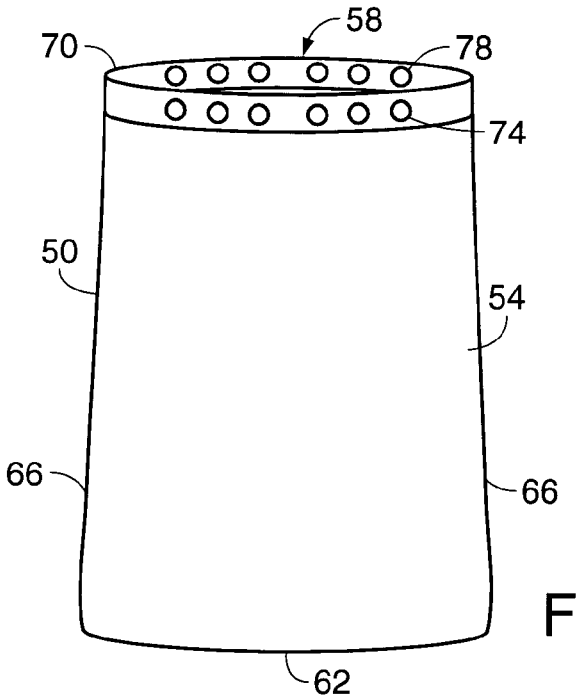
FIG. 2 is a view of one embodiment of a blanket-like member having the configuration of a bag, namely closed sides and bottom, with an open top.

A blanket-member 50 in the preferred bag-like configuration, shown in FIG. 2, consists of upper and lower portions 54 and 58 that are sealed to each other along the bottom 62 and sides 66 and open across the top 70. The upper and lower portions of the blanket-member are functionally equivalent, and are designated as such only for purpose of reference.

A plurality of fastener-members are mounted on the pajama and blanket-member of the invention. These fastener-members may be the common "snap" type of fastener having cooperative male and female kinds. Alternatively, other equivalent fastening means may be used, such as buttons, hooks, Velcro tape, or zippers.

The pajama consists of at least two, preferably up to six or more fasteners 42 mounted across the chest section of the torso portion 22 and at least two, preferably up to six or more fasteners 46 mounted across the shoulder blade portion on the back of the torso portion 22. As shown, snap fasteners (male or female) 42 and 46 are mounted to the pajama.

The upper 54 and lower 58 portions of the blanket-member each contain at least two, preferably up to six or more fasteners 74 and 78, respectively, that are mounted at a distance from the bottom of the blanket 62 that is at least equivalent to or greater than the distance from the bottom of the legs 14 of the pajama 10 to the fasteners 42 and 46 that are mounted across the pajama. As shown, snap fasteners 74 and 78 that are reciprocal to those on the pajama (i.e., female or male), are respectively mounted on the upper 54 and lower 58 portions of the blanket-member such that they face the inside of the blanket to facilitate fastening to the snap fasteners 42 and 46 of the pajama, as described below. The reciprocal snap fasteners 74 and 78 of the blanket-member are positioned so that they will align with the snap fasteners 42 and 46 of the pajama 10. The total number of snaps on the blanket will be equal to the total number of snaps on the pajama.

Figure 3:
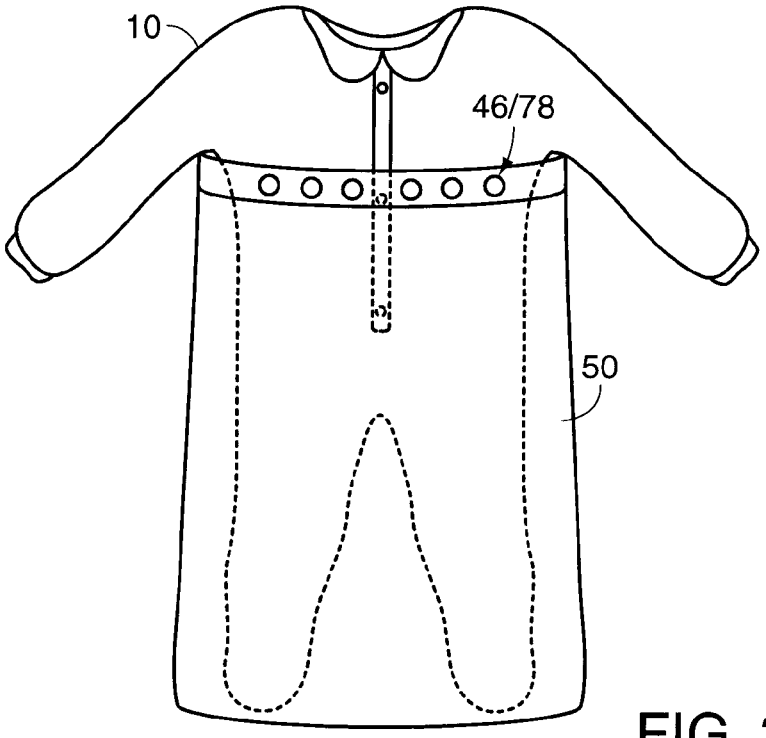
FIG. 3 is a back view of the blanket-like member of FIG. 2 showing it fastened to the pajama of FIGS. 1A and 1B.

Use of the pajama and blanket-member is straightforward. First, the pajama 10 is fitted onto a person. This is accomplished by opening the pajama 10 at the slit 26, fitting the pajama onto the wearer, and closing the slit with the fastening means 34. The blanket-member is then opened at the top 54 and placed around the person fitted in the pajama, so that the person's legs and torso are covered by the blanket (FIG. 3). Optionally, the person's arms may be covered as well. The blanket-member is positioned so that the reciprocal snap fasteners 74 of the upper portion of the blanket 54 align with the fasteners 42 of the chest section of the pajama, while the reciprocal fasteners 78 of the blanket align with the fasteners 46 of the shoulder blade section of the pajama. The fasteners and reciprocal fasteners may then be releasably joined together by pressing such together. By reversing the steps outlined above, the person can be readily released from the blanket, and if further desired, the pajama.

While the invention has been finely described, it will be appreciated by those skilled in the art that modifications may be made thereto. For example, the snap fasteners 42, 46, 74, and 78 may be replaced by Velcro, buttons, or other releasable fastener-members. Furthermore, the clothing and blanket-member may be formed from any desired fabric, cloth, or insulative material. Therefore, it is to be understood that the present invention is not limited to the sole embodiment described above, but encompasses any and all embodiments within the scope of the claims.

What is claimed is:

1. A clothing combination for keeping a person warm consisting of a pajama and a blanket, said pajama having two leg portions, a front torso portion, a back torso portion, and two arm portions;

said blanket having two equal flat portions that are sealed to each other at all but one edge so as to form a bag structure with a single opening;

said blanket being sufficiently sized to allow said pajama to fit inside said single opening so as to cover said pajama up to but not including the arm portions;

said pajama and said blanket having cooperating releasable fasteners for joining said pajama and said blanket;

said pajama fasteners being located across said front torso section and said back torso section;

said blanket fasteners being located inside said bag structure so as to align with said pajama fasteners when said pajama is placed inside said blanket.

2. The clothing combination of claim 1, wherein the fasteners comprise reciprocal snap fasteners.

3. The clothing combination of claim 1, wherein the fasteners comprise reciprocal hook and loop fasteners.

4. The clothing combination of claim 1, wherein the fasteners comprise reciprocal buttons and button holes.

5. The clothing combination of claim 1, wherein the pajama comprises an insulative material.

6. The clothing combination of claim 1, wherein the blanket comprises an insulative material.

* * * * *